US005979324A

United States Patent [19]

Burke et al.

[11] Patent Number: 5,979,324

[45] Date of Patent: Nov. 9, 1999

[54] POSITION CONTROLLER FOR A ROTATABLE ADJUSTER IN A PRINTING PRESS

[75] Inventors: David Charles Burke, Portsmouth; Frederick Elkins McCrillis, Rochester, both of N.H.

[73] Assignee: Heidelberger Druckmaschinen AG, Heidelberg, Germany

[21] Appl. No.: 09/060,635

[22] Filed: Apr. 15, 1998

[51] Int. Cl.[6] ..... B41F 3/46

[52] U.S. Cl. ..... 101/480; 101/349.1

[58] Field of Search ..... 267/150, 158, 267/164; 200/11 H; 101/480, 349.1

[56] References Cited

U.S. PATENT DOCUMENTS 3,206,563 9/1965 Locke et al. ..... 200/6 B
3,260,805 7/1966 Pihl ..... 200/11 H
3,408,462 10/1968 Davies ..... 200/6 R

FOREIGN PATENT DOCUMENTS 1196435 7/1965 Germany ..... 267/150
3742236 3/1989 Germany ..... 267/150

*Primary Examiner*—Edgar Burr
*Assistant Examiner*—Daniel J. Colilla
*Attorney, Agent, or Firm*—Kenyon & Kenyon

[57] ABSTRACT

A position controller comprising an adjusting rod having a first end having at least three flat sides and a second end and an adjustable part interacting with the second end and adjustable through rotation of the adjusting rod. A leaf spring set interacts with a first of the at least three flat sides to prevent unwanted movement within the position controller. A particular application is found in making printing press adjustments.

11 Claims, 4 Drawing Sheets

POSITION CONTROLLER FOR A ROTATABLE ADJUSTER IN A PRINTING PRESS

FIELD OF THE INVENTION

The present invention relates generally to position controllers for rotational adjustments and more specifically to position controllers for making adjustments to an ink form roll in a printing press.

RELATED TECHNOLOGY

As shown in FIG. 1 and discussed later, a prior art printing press has an adjustment mechanism for an adjustable cam for making ink form roll adjustments. A hexagonal (hex) adjusting rod with an hexagonal cross section at one end and a gear at another end can be used to adjust the position of the cam. When the hex adjusting rod is rotated, the gear rotates a shaft, on which an adjustable part is mounted. Due to an internal threading of the cam and the fact that the cam cannot rotate, the rotation of the shaft causes a translation of the cam. A compression spring provides resistance to the movement of cam, so that the various components of the adjustment mechanism are not free to move without a sufficient torque at the hex adjusting rod. Thus the hex adjusting rod can be used to adjust an adjustable part in a printing press.

However, the compression spring located at the cam has been known to malfunction or deteriorate over time, and also not to provide a sufficient resistance while still permitting adjustment of the hex adjusting rod.

SUMMARY OF THE INVENTION

The present invention provides a position controller comprising an adjusting rod having a first end with at least three flat sides and a second end, an adjustable part connected to the second end and adjustable through rotation of the adjusting rod, and a first set and a second set of leaf springs, the first set interacting with a first of the at least three flat sides and the second set interacting with a second of the at least three flat sides.

A resistance torque is thus provided to the various components of the position controller through the leaf spring sets.

Advantageously, the first end of the adjusting rod has six flat sides, i.e. is hexagonally shaped. The first set of leaf springs interacts with the first of the hexagonal sides and advantageously the second set can act on the second of the hexagonal sides, the second side being directly opposite the first side. It is also advantageous in this arrangement that the first set of leaf springs be parallel to the second set.

Each set of leaf springs may comprise one or advantageously a plurality of leaf springs. The holding torque provided by the leaf springs on the adjusting rod can be easily varied by adjusting the properties, number and/or thickness of the leaf springs. While the holding torque can vary, a holding torque of 10 to 15 in-lb may be advantageous for a typical ink form roller socket in a printing press.

The present invention advantageously also provides an equal torque resistance for both clockwise and counterclockwise motions of the adjusting rod. The holding force provided by the sets of leaf springs operates over a large surface area, which minimizes surface wear. No special settings are required. Friction such as found in a threaded relationship is not used to provide resistance, so that stripping of threads is not a problem. The present invention permits a compact design, and also permits the adjusting rod to move axially or "float" in a third direction while still providing torque resistance in the other two directions.

A cover may be provided over the leaf springs to prevent or reduce contamination. The cover may either cover the first end or permit the first end to protrude through a hole.

The present invention advantageously is used for adjustment of rolls in a printing press, including for adjustment of the position of an ink form roll. Thus the adjustable part advantageously may be a cam for adjusting an ink form roll.

BRIEF DESCRIPTION OF THE DRAWINGS

Other characteristics and advantages of the present invention may be better understood based on the following figures, in which.

DETAILED DESCRIPTION

Figure 1:
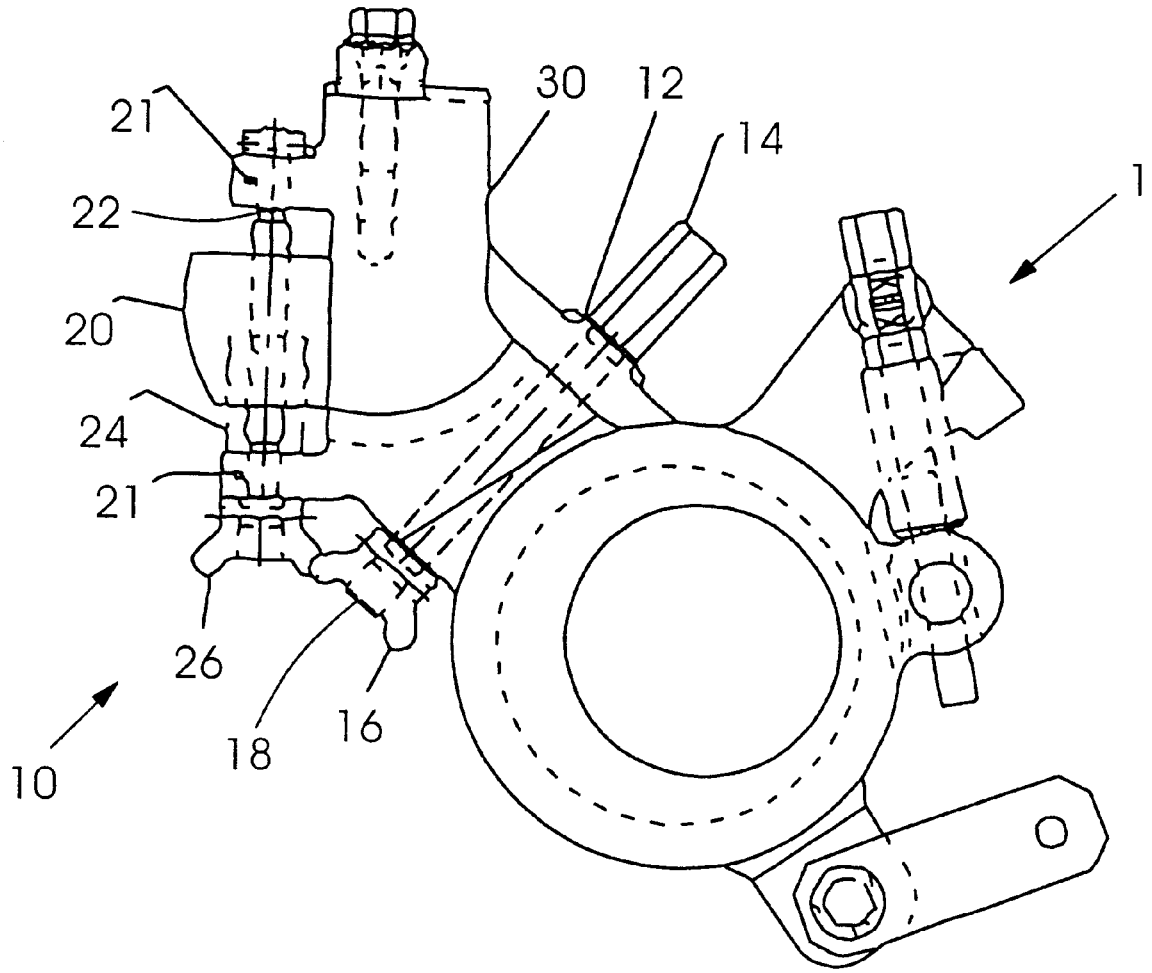
Fig. 1 (PRIOR ART)
FIG. 1 shows a prior art position controller for a printing press part.

FIG. 1 shows a prior art position controller 10 for use in a printing press 1. The controller 10 includes an hexagonal (hex) adjusting rod 12 with an hexagonal cross section at one end 14 and a gear 16 at another end 18 can be used to adjust the position of an adjustable part 20 in the printing press 1. The adjustable part 20 may be for example a cam for adjusting an ink form roll.

The adjustable part 20 has internal threads and is threadedly connected on a shaft 22 supported by arms 21, one end of the shaft forming a gear 26. The gear 26 interacts with a housing section 30 of the printing press to prevent rotation of the adjustable part but to permit translation along the shaft 22 direction. The housing section 30 also rotatably supports the shaft 22 through the arms 21.

When the hex adjusting rod 12 is rotated, the gear 16 rotates the gear 26 to rotate the shaft 22, on which the adjustable part 20 is threadedly mounted. Due to the internal threading of the part 20 and the fact the part 20 cannot rotate, the rotation of the shaft causes a translation of the part 20 along the axis of the shaft 22. A compression spring 24 provides resistance to the movement of part 22, so that, the various components of the adjustment mechanism are not free to move without a sufficient torque at the hex adjusting rod 12.

Figure 2:
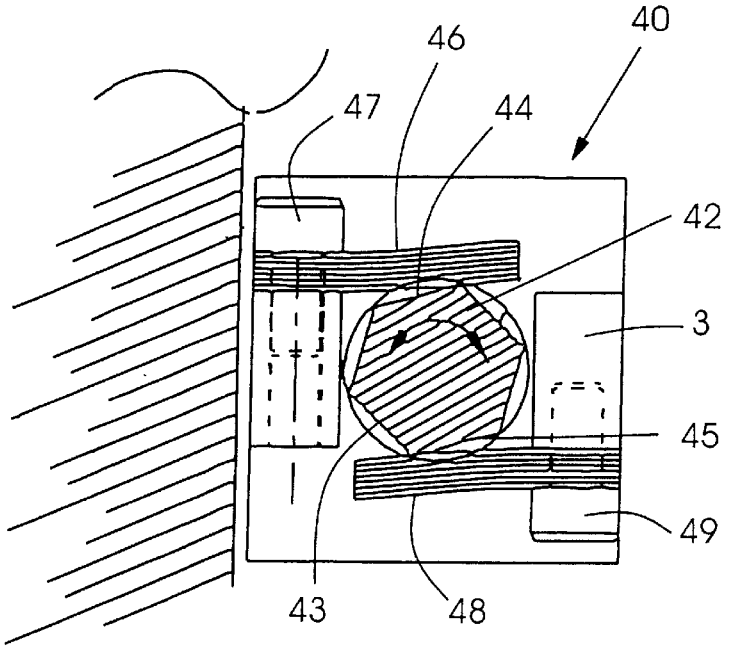
FIG. 2 shows a first embodiment of the position controller of the present invention.

FIG. 2 shows a position controller 40 according to one embodiment of the present invention having a hex adjusting rod 42, a first leaf spring set 46 and a second leaf spring set 48. The hex adjustment rod has a first end 43 with six flat sides, including a first side 44 and second opposing side 45. As shown, the first leaf spring set 46 interacts with the first flat side and the second leaf spring set 48 interacts with the second flat side 45. (Although these sides change as the rod 42 rotates).

Each leaf spring set 46, 48 has a plurality of leaf springs, as shown, each of which has a certain thickness and is a flat thin, advantageously metal and rectangular, sheet with a defined spring resistance or constant. Each flat thin sheet has a hole (not shown) at one end through which a fastener may be fitted for holding the leaf spring in place. The first leaf spring set 46 has a fastener 47, such as a screw or nut and bolt combination. The second leaf spring set 48 likewise has a fastener 49. With the fasteners of the present invention it is possible to quickly and easily adjust the spring constant of the entire leaf spring sets 46 and 48 by adding or removing individual leaf springs. The fasteners 47, 49 may connect the leaf spring sets to a housing 3.

In this embodiment, the leaf spring set 46 and 48 are advantageously parallel to one another, although located on opposite sides of the hex adjusting rod 42.

As would be understood to one of skill in the art, the leaf springs interact with the hex adjusting rod 42 to provide a resistance to turning of the rod. The position controller 40 of the present invention thus prevents unwanted turning of the rod 42 or other interconnected parts.

Figure 5:
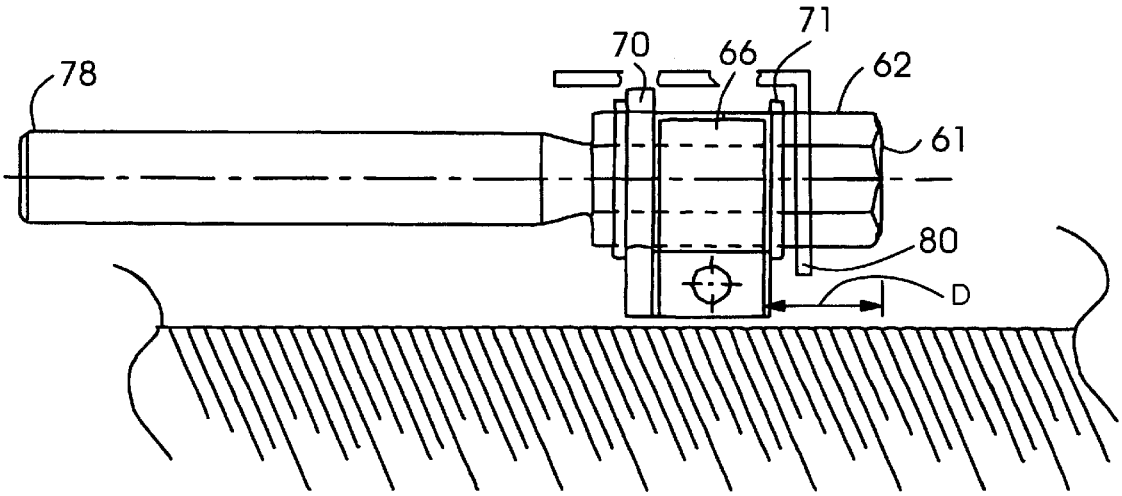
FIG. 5 shows a side view of the third embodiment.

It should be noted that the leaf spring sets 46 and 48 are located axially away from the very end of the hex adjusting rod 42, as with the embodiment shown in FIG. 5.

Figure 3:
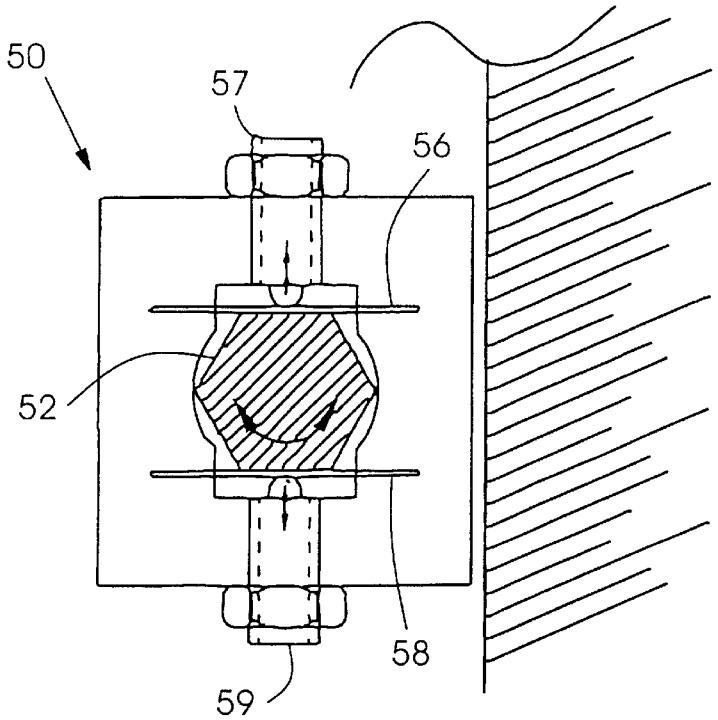
FIG. 3 shows a second embodiment of the position controller of the present invention.
Figure 4:
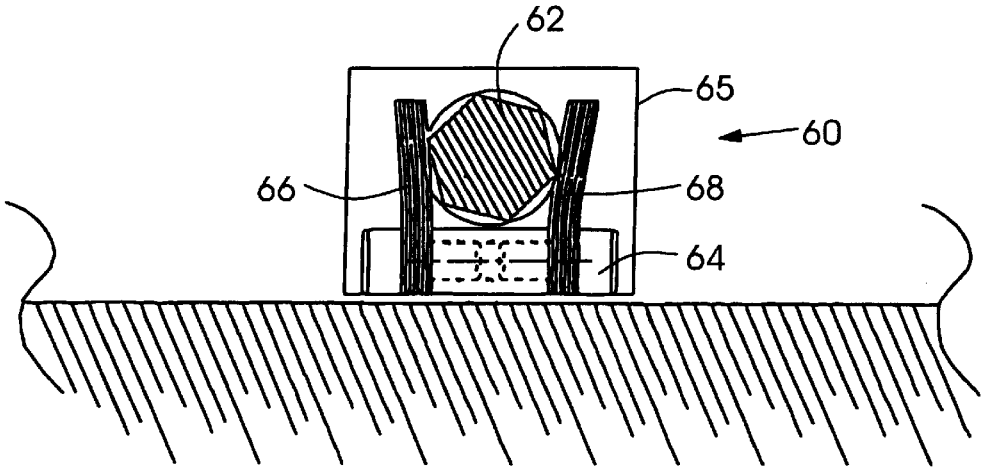
FIG. 4 shows a third embodiment of the position controller of the present invention.

As will be understood by one in the art, the position controller 40, as well as those position controllers shown in FIGS. 3 and 4, can be used in conjunction with the prior art device shown in FIG. 1, or advantageously can be used with a device designed so that the spring 24 shown in FIG. 1 may be eliminated.

FIG. 3 shows a position controller 50 according to another embodiment of the present invention in which a first leaf spring set includes a single leaf spring 56 and a spring plunger 57 for forcing the leaf spring 56 against a flat face of hex adjusting rod 52. Likewise, a second leaf spring set includes a single leaf spring 58 and a spring plunger 59 for forcing the leaf spring 58 against an opposing flat face of hex adjusting rod 52.

FIG. 4 shows a position controller 60 according to yet another embodiment of the present invention in which a first leaf spring set 66 interacts with a flat face of a hex adjusting rod 62 and a second leaf spring set 68 interacts with an opposing flat face to restrict free movement of the hex adjusting rod 62 and connected parts of the position controller 60. The leaf spring sets 66 and 68 are parallel to one another and are fastened by a common fastener 64 located on a mounting bracket 65.

FIG. 5 shows a partial side view of the embodiment of FIG. 4, from which it is clear that the leaf spring sets 66 and 68 are set away axially from a tip 61 of the adjusting rod 62 by a distance D. Retaining rings 70 and 71 on either axial side of the leaf spring sets 66 and 68 can be provided to prevent rotation of the leaf springs about the fastener 64. It will be understood by one in the art that a second end 78 may have a gear for interacting with an adjustable part as shown in FIG. 1. A cover 80 may partially or fully cover the leaf spring sets 66 and 68 to provide protection and may be attached to the housing section.

Figure 6A:
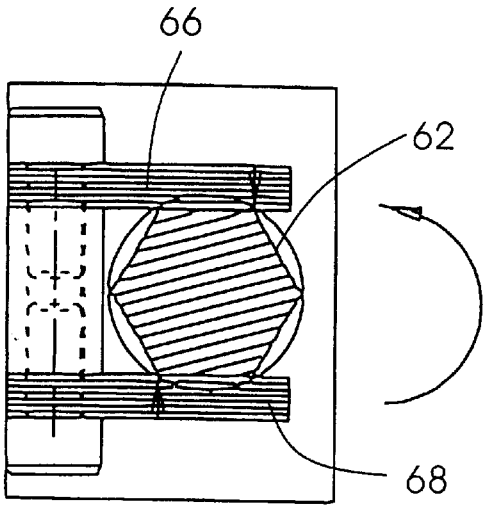
FIGS. 6A, 6B, and 6C show the third embodiment at different stages.
Figure 6B:
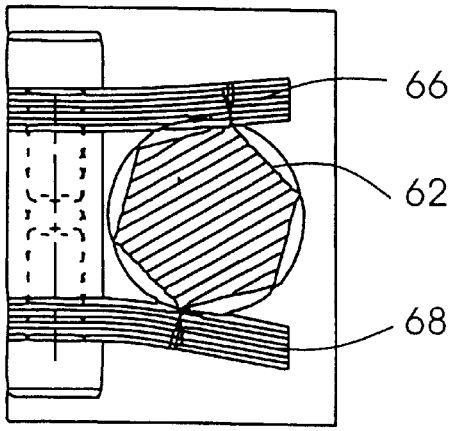
Figure 6C:
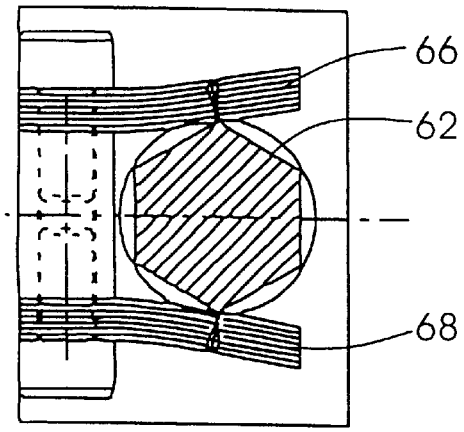

FIGS. 6A, 6B and 6C show the different deflection positions of the leaf spring sets 66 and 68 of the embodiment of FIG. 4 as the adjusting rod 62 is rotated. FIG. 6A shows a rest position of the rod 62. FIG. 6B shows an intermediate deflection position, as might occur at the beginning of a rotation and FIG. 6C shows a maximum deflection position of the leaf spring sets 66 and 68, before the adjusting rod 62 reaches a new rest position as it is turned further in the same direction. The resistance torque from the leaf spring sets may be varied easily by the amount, thickness or type of leaf springs used, although advantageously the same number of springs are used for each leaf spring set.

What is claimed is:

1. A position controller for a printing press, the position controller comprising:

an adjusting rod having a first end having at least three flat sides and a second end;

a cam of the printing press interacting with the second end and adjustable through rotation of the adjusting rod;

a first leaf spring set including a plurality of first leaf springs; and a second leaf spring set including a plurality of second leaf springs;

the first leaf spring set interacting with a first of the at least three flat sides and the second leaf spring set interacting with a second of the at least three flat sides.

2. The position controller as recited in claim 1 wherein the first end of the adjusting rod has six flat sides.

3. The position controller as recited in claim 1 wherein the first side is directly opposite the second side.

4. The position controller as recited in claim 3 wherein the first leaf spring set is parallel to the second set.

5. The position controller as recited in claim 1 wherein the first leaf spring set is parallel to the second set.

6. The position controller as recited in claim 1 further comprising at least one retaining ring for restricting movement of the first spring leaf set.

7. The position controller as recited in claim 1 wherein the first leaf spring set and second leaf spring set are connected by a common fastener on one side of the adjusting rod.

8. The position controller as recited in claim 1 wherein the first leaf spring set is fastened by a first fastener and the second leaf spring set is fastened by a second fastener located on an opposite side of the adjusting rod from the first fastener.

9. The position controller as recited in claim 1 wherein the first leaf spring set and second leaf spring set are located axially distant from a tip of the adjusting rod.

10. The position controller as recited in claim 1 further comprising a cover for the first leaf spring set and the second leaf spring set.

11. The position controller as recited in claim 1 wherein at least one of a number of first and second leaf springs, a thickness of each first and of each second leaf spring, and a type of each first and of each second leaf spring are variable so as to provide a holding torque of 10 to 15 in-lb on the adjusting rod.

* * * * *